US005109235A

United States Patent [19]

Sasaki

[11] Patent Number: 5,109,235

[45] Date of Patent: Apr. 28, 1992

[54] RECORDING DENSITY CORRECTING APPARATUS

[75] Inventor: Eiichi Sasaki, Yokohama, Japan

[73] Assignee: Ricoh Company, Ltd., Tokyo, Japan

[21] Appl. No.: 388,329

[22] Filed: Aug. 1, 1989

[30] Foreign Application Priority Data

Aug. 18, 1988 [JP] Japan ..... 63-204998
Jan. 31, 1989 [JP] Japan ..... 1-21516

[51] Int. Cl.[5] ..... B41J 2/325

[52] U.S. Cl. ..... 346/76 PH; 400/120; 358/298

[58] Field of Search ..... 346/76 PH; 400/120; 358/298

[56] References Cited

U.S. PATENT DOCUMENTS 4,535,340 8/1985 Moriguchi et al. ..... 346/76 PH

FOREIGN PATENT DOCUMENTS 0064468 4/1986 Japan ..... 400/120
0164859 7/1986 Japan ..... 346/76 PH
0033657 2/1987 Japan .

*Primary Examiner*—Benjamin R. Fuller
*Assistant Examiner*—Huan Tran
*Attorney, Agent, or Firm*—Cooper & Dunham

[57] ABSTRACT

A recording density correcting apparatus in a recorder for performing a recording operation at a multiple gradation by a thermal head having a plurality of heating resistors. The apparatus has a counting device for counting a level frequency with respect to the number of pulses applied to the heating resistors, a heating amount calculating device for calculating the heating amount of the heating resistors by the counted value provided by the counting device, and a pulse control device for controlling the pulse width or the number of pulses applied to the heating resistors by the heating amount calculated by the heating amount calculating device such that the recording density becomes constant.

13 Claims, 13 Drawing Sheets

RECORDING DENSITY CORRECTING APPARATUS

BACKGROUND OF THE INVENTION

The present invention relates to an apparatus for correcting a recording density in a heat sensitizing recorder or a thermo-transfer recorder.

In the heat sensitizing recorder or the thermo-transfer recorder for performing a recording operation in white and black by using a thermal head having a plurality of heating resistors, a recording density correcting apparatus is constructed such that the power supplied to the heating resistors is constantly controlled to hold the recording density constantly by counting the number of black dots to be recorded and changing the width of a pulse applied to the heating resistors from this counted valve so as to control a heating amount of the heating resistors. Such a recording density correcting apparatus is discussed in Japanese Laid-Open Publication No. 58-124679 for example.

In the conventional recording density correcting apparatus, the number of black dots is counted and the width of the pulse applied to the heating resistors is changed from this counted value, thereby controlling the heating amount of the heating resistors. Accordingly, the heating amount of the heating resistors is controlled by a binary system by using information as to whether there is a black dot or not, so that such a correcting apparatus is applied to only a recorder for performing the recording operation in black and white. Therefore, the above recording density correcting apparatus cannot be applied to the recorder for recording an image at a multiple gradation and the power supplied to the heating resistors is changed by the number of operations of the plurality of heating resistors in the thermal head, thereby changing the recording density.

Therefore, in the recorder for recording an image at a multiple gradation, it is considered that the number of pulses applied to the plurality of heating resistors in the thermal head is counted every gradation level and the applied pulse width or the amplitude of applied pulse of the heating resistors is changed by each counted value every gradation level such that the recording density becomes constant. However, in such an apparatus, the construction of the apparatus is complicated and it is necessary to perform the processings at high speed.

Further, there is normally dispersion in resistance value of the heating resistors between the thermal heads, which dispersion occurs when they are manufactured. The heating amount of the heating resistors is changed by this dispersion and the recording density is thereby changed. The dispersion in average resistance value of the heating resistors is ±20% even in the thermal head of a thin film type in which the dispersion in resistance value of the heating resistors is relatively small. Accordingly, in the thermal head having the average resistance value 2000Ω of the heating resistors, there is dispersion ranged from minimum value 1600Ω to maximum value 2400Ω with respect to the average resistance value of the heating resistors and therefore the dispersion range is 800Ω. Therefore, when the energy applied to the heating resistors is corrected by correction data according to the dispersion in resistance value of the heating resistors with the reference of the resistance value thereof as 2000Ω such that the recording density becomes constant, energy $E_{max}$ applied to the heating resistors in maximum value $R_{max}$ of the average resistance value of the heating resistors is provided by the following formula, $$E_{max}=V^2t/R_{max}=V^2t/1600$$

where the width of pulses applied to the heating resistors is t and the voltage applied to the heating resistors is V. Futher, when the average resistance value of the heating resistors in minimum value $R_{min}$, energy $E_{min}$ applied to the heating resistors is provided by the following formula, $$E_{min}=V^2t/R_{min}=V^2t/2400.$$

Accordingly, $$E_{max}/E_{min}=2400/1600=1.5$$

so that the energy applied to the heating resistors is changed 1.5 times by the dispersion in resistance value thereof and it is therefore necessary and complicated to make the above correction data every time when the thermal heads are exchanged.

SUMMARY OF THE INVENTION

It is therefore a first object of the present invention to provide a recording density correcting apparatus for constantly holding the recording density in a recorder for recording an image at a multiple gradation.

A second object of the present invention is to provide a recording density correcting apparatus in which the construction is simplified and it is not necessary to make the correction data every time when the thermal heads are exchanged.

The above first and second objects of the present invention can be achieved by a recording density correcting apparatus in a recorder for performing a recording operation at a multiple gradation by a thermal head having a plurality of heating resistors comprising a counting device for counting a level frequency with respect to the number of pulses of applied to the heating resistors; a heating amount calculating device for calculating the heating amount of the heating resistors by the counted value provided by the counting device; and a pulse control device for controlling the pulse width or the number of pulses applied to the heating resistors by the heating amount calculated by the heating amount calculating device such that the recording density becomes constant. The recording density correcting apparatus may further comprise a correcting device for correcting the pulse width or the number of pulses applied to the heating resistors by detecting the respective resistance values of the plurality of heating resistors such that the recording density becomes constant.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a recording density correcting apparatus in the present invention will now be described in detail with reference to the accompanying drawings.

Figure 1:
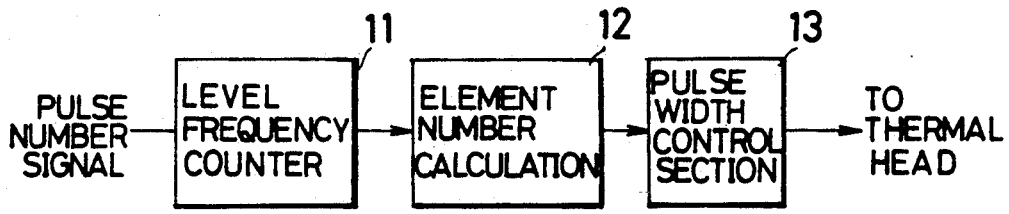
FIG. 1 is a block diagram showing a recording density correcting apparatus in one embodiment of the present invention.

FIG. 1 shows a recording density correcting apparatus in one embodiment of the present invention.

In this embodiment, in a recorder for recording an image at a multiple gradation by a thermal head having a plurality of heating resistors, the recording density is constantly controlled even when the number of operations of the heating resistors is changed. Level frequency counter 11 counts the level frequency of a pulse number signal (which indicates the number of pulses to be applied to respective heating resistors in the recording operation in one dot) indicative of the number of applied pulses of each dot every one line. Namely, level frequency counter 11 counts the level frequency of the pulse number signal every one line indicating how the pulse number signal is distributed at each level. The level frequency is thus counted on each line. Heating amount calculating section 12 is composed of a heating element (or heating resistor) number calculating section and calculates the number of operated heating elements at each gradation level on the basis of the level frequency counted by level frequency counter 11. Pulse width control section 13 accumulates the number of operated heating elements at each gradation level calculated by heating amount calculating section 12 and changes the time for applying energy to the thermal head on the basis of the number of operated heating elements at each gradation level, thereby constantly controlling the recording density.

Figure 2:
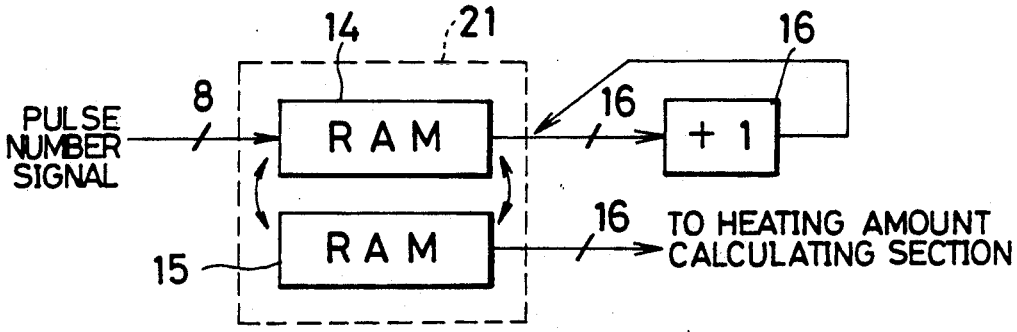
FIG. 2 is a block diagram showing a level frequency counter in this embodiment.

FIG. 2 shows the construction of the above level frequency counter 11. Random access memories (RAMs) 14 and 15 respectively have a capacity twice 256 byte and constitute frequency RAM 21 and are alternately used every measurement of the level frequency with respect to the pulse number signal on one line. A pulse number signal (which indicates the number of pulses to be applied to respective heating resistors in the record in one dot) indicative of the number of applied pulses of each dot, and a select signal for selecting the odd and even numbers of heating elements are inputted to address lines of random access memories 14 and 15.

Figure 3:
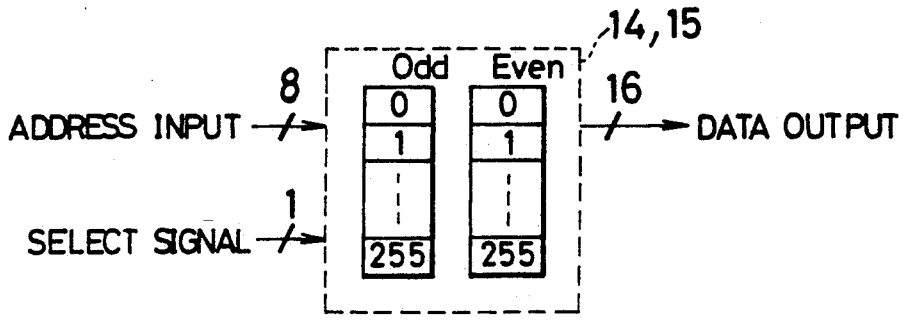
FIG. 3 is a block diagram showing a frequency RAM in the level frequency counter.

This select signal is inputted to most significant bits on the address lines of RAMs 14 and 15. As shown in FIG. 3, even number counting portion Even for counting the level frequency by the pulse number signal of an even dot on one line, and odd number counting portion Odd for counting the level frequency by the pulse number signal of an odd dot on one line are switched everytime time when the pulse number signal of each dot is inputted to these RAMs 14 and 15. Such a construction is provided to operate the plurality of heating elements at different timings by dividing these elements into odd and even number blocks when the plurality of heating elements in the thermal head are operated. The pulse number signal of each dot is inputted to the address lines of RAMs 14 and 15 so that number 1 is added by adding means 16 to the content of an address corresponding to the above pulse number signal and the added result is saved to this address. The contents of RAMs 14 and 15 are set to zero in advance. RAMs 14 and 15 have address constructions as shown in FIG. 3 in which the pulse number signal corresponds to the address, and the counted value of the frequency at each gradation level becomes the content of each address. Two RAMs 14 and 15 are toggle-operated every time when the pulse number signal on one line is inputted to these RAMs. When one of these RAMs 14 and 15 counts the level frequency on one line, the other transfers the counted data to the next heating amount calculating section 12 from 0 to 254 levels constituting the multiple gradation with respect to the odd number heating elements, and thereafter transfers the counted data to heating amount calculating section 12 from 0 to 254 levels constituting the multiple gradation with respect to the even number heating elements.

Figure 4:
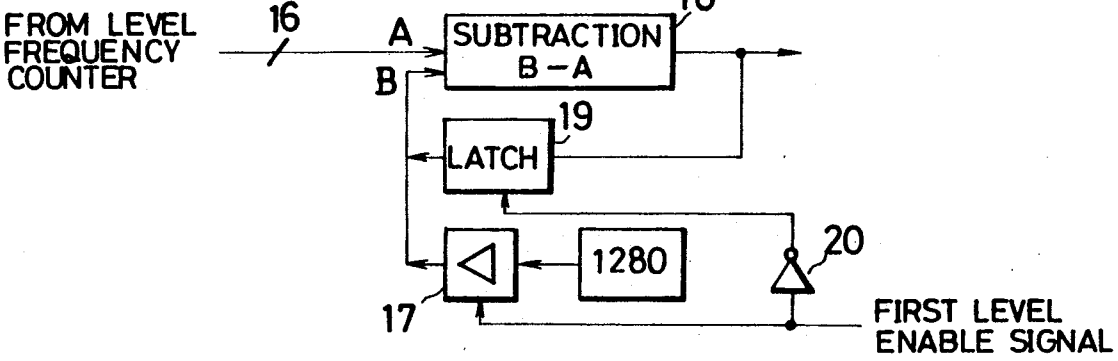
FIG. 4 is a block diagram showing a heating amount calculating section in the above embodiment.

FIG. 4 shows the construction of the above heating amount calculating section 12.

Gate 17 is open by a first level enable signal and data $A_0$ to 0 level (first gradation level) from level frequency counter 11 is subtracted from simultaneous energy applying maximum heating element number 1280 by subtracter 18, and the subtracted result is transferred to the next pulse width control section 13. After data $A_0$ at 0 level is subtracted from simultaneous energy applying maximum heating element number 1280, the number of odd heating elements simultaneously operated at the first level is calculated. Latch circuit 19 is operated by adding the first level enable signal thereto through inverter 20 so that the first level enable signal attains a turning-off state. The subtracted result of subtracter 18 is latched by latch circuit 19 and the first level enable signal is in the turning-off state so that gate 17 is closed. Data $A_1$ at 1 level from level frequency counter 11 is subtracted from the latched value of latch circuit 19 by subtracter 18, and the subtracted result is transferred to the next pulse width control section 13 as the number of odd heating elements simultaneously operated at a second gradation level and is latched by latch circuit 19. Similarly, the number of odd heating elements simultaneously operated at the second gradation level to the 254th gradation level is calculated and is transferred to pulse width control section 13. Further, with respect to the even heating elements, the number of even heating elements simultaneously operated at respective gradation levels is similarly calculated and is transferred to pulse width control section 13.

Figure 5:
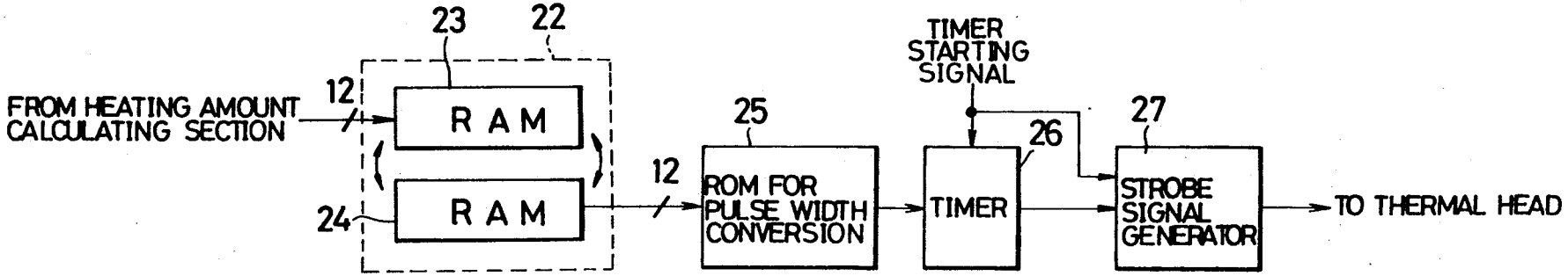
FIG. 5 is a block diagram showing a pulse width converting section in the above embodiment.

FIG. 5 shows the construction of the above pulse width control section 13.

In this figure, data transferred from heating amount calculating section 12 are stored to RAM 22 for pulse width. RAM 22 for pulse width is composed of two RAMs 23 and 24 and is toggle-operated every time when data on one line are inputted to this RAM 22. When one of RAMs 23 and 24 stores the data transferred from heating amount calculating section 12, the other outputs the stored data to read only memory (ROM) 25 for converting the pulse width in synchronization with a strobe signal. This outputting operation of the stored data is sequentially performed according to data at the first level with respect to the odd heating elements, data at the first level with respect to the even heating elements, data at the second level with respect to the odd heating elements, data at the second level with respect to the even heating elements, . . . , data at the 255th level with respect to the odd heating elements, and data at the 255th level with respect to the even heating elements. ROM 25 for pulse width conversion inputs the input data thereto as an address signal and reads out the data and thereby converts the input data to a timer value for canceling the change in recording density by the simultaneous operation of the heating elements. In timer 26, the timer value from ROM 25 for pulse width conversion is set when the odd heating elements and the even heating elements are operated at each gradation level, and timer 26 is triggered by a timer starting signal. Strobe pulse generator 27 generates a strobe pulse until timer 26 times up since the above timer starting signal is inputted to this timer, and strobe pulse generator 27 applies this strobe pulse to the thermal head.

Figure 7:
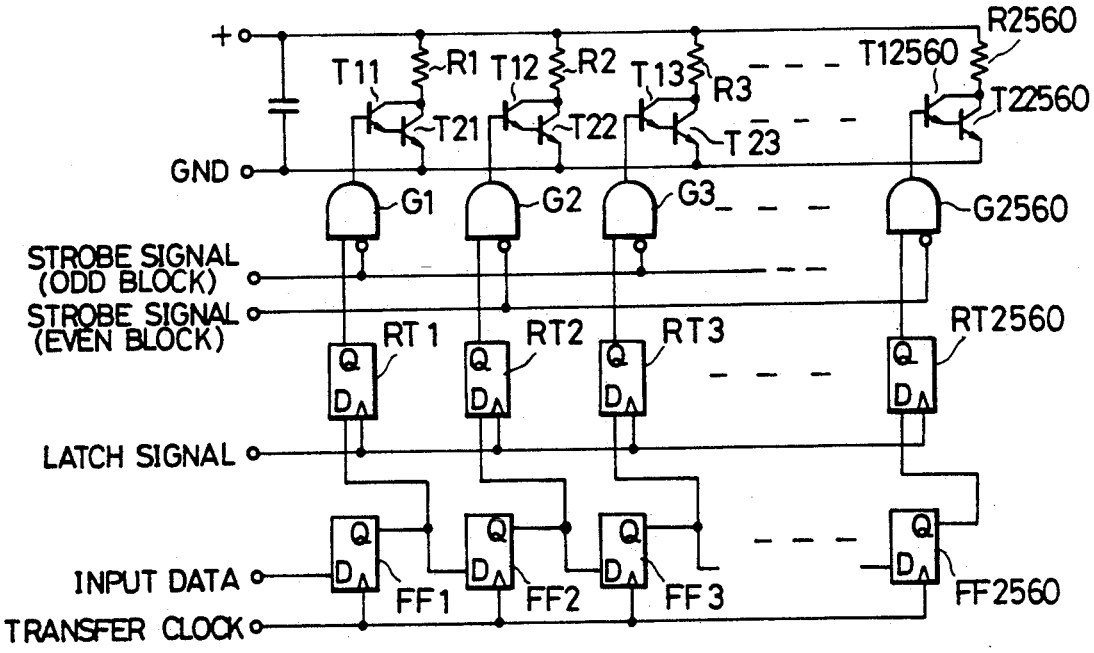
FIG. 7 is a block diagram showing an example of a circuit construction of a thermal head.

FIG. 7 shows the circuit construction of the above thermal head.

Figure 6:
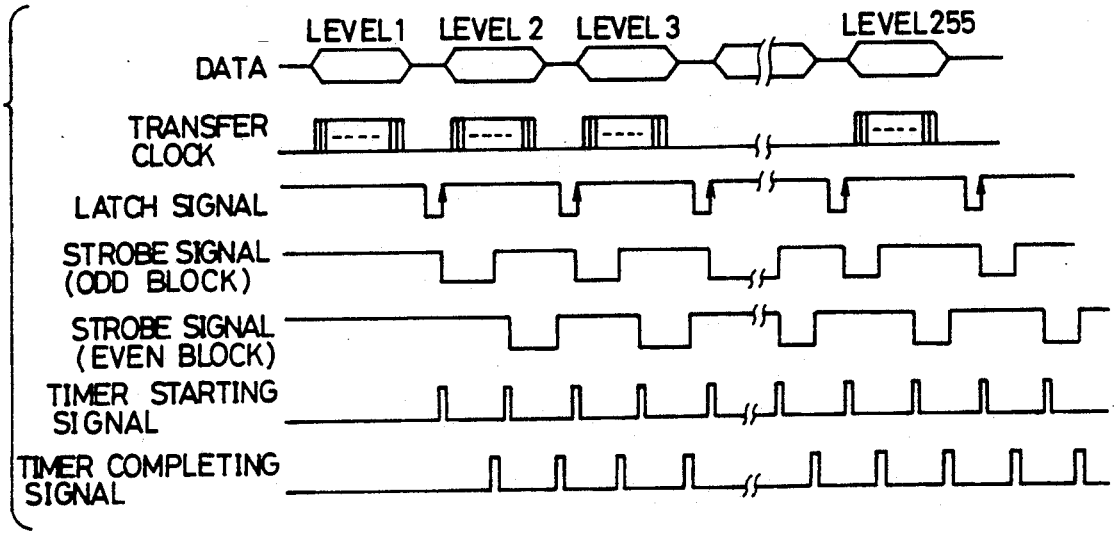
FIG. 6 is a timing chart in the recording density correcting apparatus in the above embodiment.

In this figure, in the thermal head, a series of 2560 heating elements R1 to R2560 are arranged and an image is recorded on every one line by these heating elements R1 to R2560. A shift register composed of D-flip flops FF1 to FF2560 inputs the image data by a transfer clock signal on every one line. Latch circuits RT1 to RT2560 sequentially latch the image data within shift registers FF1 to FF2560 by a latch signal on every one line. Gates G1 to G2560 pass therethrough the image data from latch circuits RT1 to RT2560 by a strobe pulse from strobe pulse generator 27 on every one line in a sequential order of odd dot data, even dot data. Transistors T11 to T12560 and T21 to T22560 divide heating elements R1 to R2560 into odd and even number blocks and the image is recorded by sequentially flowing an electric current through these blocks by image data from gates G1 to G2560. In this case, as shown in FIG. 6, the image data at the first level is transferred to shift registers FF1 to FF2560 and are latched by latch circuits RT1 to RT2560. Thereafter, the strobe pulse from strobe pulse generator 27 with respect to odd gates G1, G3, . . . , G2559 attains an active state so that odd gates G1, G3, G2559 are open. Then, the strobe pulse attains the turning-off state by a timer completing signal from timer 26 (by the timing-up of timer 26) so that odd gates G1, G3, . . . , G2559 are closed. Next, the strobe pulse from strobe pulse generator 27 with respect to even gates G2, G4, . . . , G2560 attains the active state so that even gates G2, G4, . . . , G2560 are open. Then, the strobe pulse attains the turning-off state by the timer completing signal from timer 26, and even gates G2, G4, . . . , G2560 are closed. Next, the image data at the second level are transferred to shift registers FF1 to FF2560 and are latched by latch circuits RT1 to RT2560. Thereafter, the strobe pulse from strobe pulse generator 27 with respect to odd gates G1, G3, . . . , G2559 attains the active state so that odd gates G1, G3, . . . , G2559 are open. Then, the strobe pulse attains the turning-off state by the timer completing signal from timer 26 and odd gates G1, G3, . . . , G2559 are closed. Next, the strobe pulse from strobe pulse generator 27 with respect to even gates G2, G4, . . . , G2560 attains the active state so that even gates G2, G4, . . . , G2560 are open. Then, the strobe pulse attains the turning-off state by the timer completing signal from timer 26, and even gates G2, G4, . . . , G2560 are closed. Similarly, the above operations are repeatedly performed with respect to the image data from the third level to the 255th level.

In this embodiment, the level frequency with respect to the number of pulses applied to the heating elements is counted and the heating amount of the heating elements is calculated by this counted value. The width of the pulses applied to the heating elements is controlled by this heating amount such that the recording density becomes constant. Accordingly, the recording density can be constantly held irrespective of the combination of the gradation data. Further, the frequency with respect to the number of pulses applied to the heating elements is counted and the heating amount of the heating elements is calculated by this counted value, and the width of pulses applied to the heating elements is controlled by this heating amount. Accordingly, the construction of the apparatus is simplified and the circuit structure is not large-sized even when the number of data inputs of the thermal head is increased.

Figure 8:
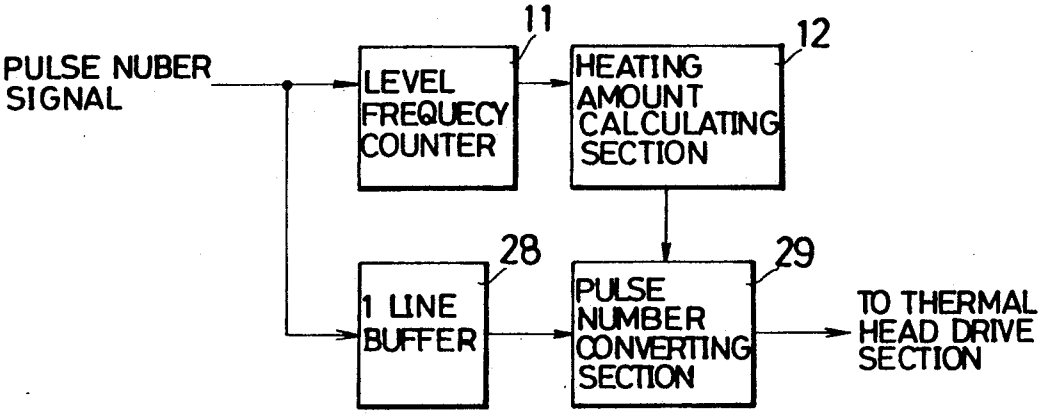
FIG. 8 is a block diagram showing the recording density correcting apparatus in another embodiment of the present invention.

FIG. 8 shows another embodiment of the recording density correcting apparatus in the present invention.

In this embodiment, the present invention is applied to a recorder for recording an image at a multiple gradation by the number of pulses applied to the heating elements with a thermal head having a plurality of heating resistors. In this embodiment, the number of pulses applied to the heating elements is controlled instead of the control of the width of pulses applied to the heating elements. Level frequency counter 11 and heating amount calculating section 12 have constructions similar to those in the above-mentioned embodiment. The number of operated heating elements at each gradation level calculated by heating amount calculating section 12 is accumulated to pulse number converting section 29. Further, a pulse number signal (indicating the number of pulses to be applied to respective heating resistors in the record of one dot) idicative of the number of applied pulses of each dot is sequentially accumulated to one line buffer 28 every one line. Pulse number converting section 29 converts the pulse number signal accumulated in one line buffer 28 based on the accumulated number of operated heating elements at each gradation level to data for canceling the change in recording density by the number of operated heating elements at each gradation level. Thermal head drive section drives the thermal head by the pulse number signal from pulse number converting section 29 to record the image at multiple gradation.

Figure 9:
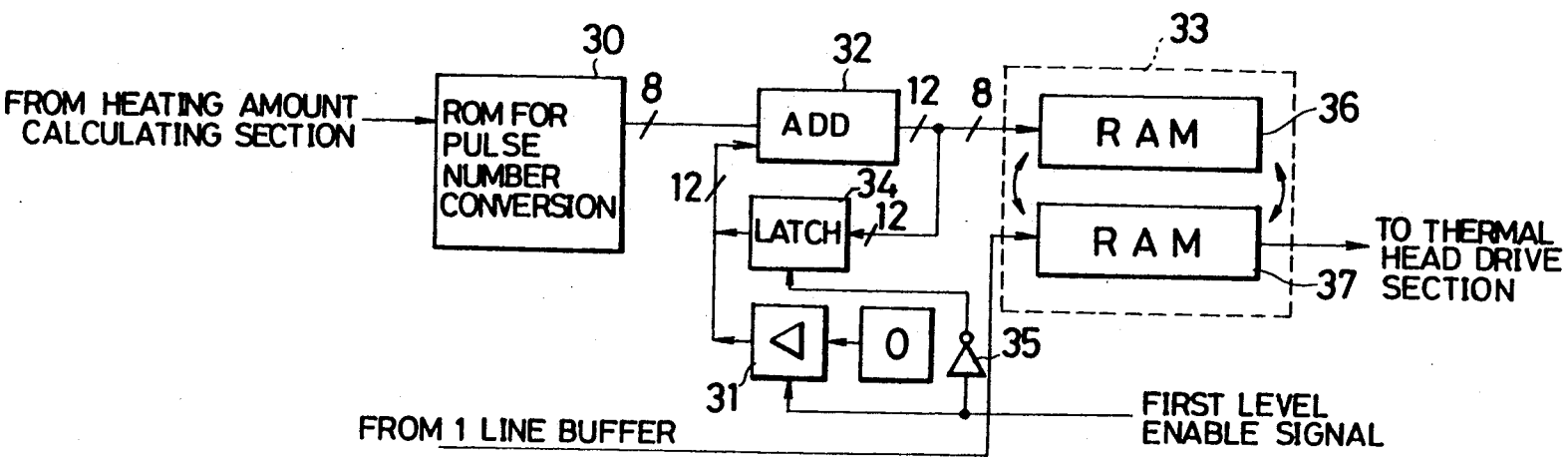
FIG. 9 is a block diagram showing the pulse width converting section in this another embodiment.

FIG. 9 shows the construction of the above pulse number converting section 29.

The data with respect to the number of operated heating elements at each gradation level transferred from heating amount calculating section 12 are converted by ROM 30 for pulse number conversion to data for making the recording density constant irrespective of the number of operated heating elements at each gradation level of the thermal head. These data are data such that the recording density is equal to that by one pulse when one heating element is operated. By a first level enable signal, gate 31 is open and data at 0 level with respect to the odd heating elements from ROM 30 for pulse number conversion are added to value 0 by adder 32, and its upper 8 bits are written to the next RAM 33 for pulse number conversion. Output data of adder 32 are composed of an integer portion with respect to the upper 8 bits and a portion less than a decimal point with respect to the lower 4 bits. Latch circuit 34 is operated when the first level enable signal is added to this latch circuit through inverter 35 and the first level enable signal attains a turning-off state. The added result of adder 32 is latched by latch circuit 34 and gate 31 is closed by the turning-off operation of the first level enable signal. The data at the first level with respect to the odd heating elements from ROM 30 for pulse number conversion are added by adder 32 to the latched value of latch circuit 34. Thus, the upper 8 bits of the added result are written to the next RAM 33 for pulse number conversion and the output data of adder 32 are latched by latch circuit 34. Similarly, the data at the second level to the 254th level with respect to the odd heating elements from ROM 30 for pulse number conversion are processed and written to RAM 33 for pulse number conversion. Further, the data at each gradation level with respect to the even heating elements are similarly processed and written to RAM 33 for pulse number conversion. RAM 33 for pulse number conversion is constituted by RAMs 36 and 37 respectively having a capacity twice 256 byte, and RAMs 36 and 37 are toggle-operated every one line. When the data from adder 32 are written to one of these RAMs 36 and 37, the data from one line buffer 28 are inputted to the other as an address input so that the content of this address is transferred as the real pulse number signal to the thermal head drive section.

Figure 10:
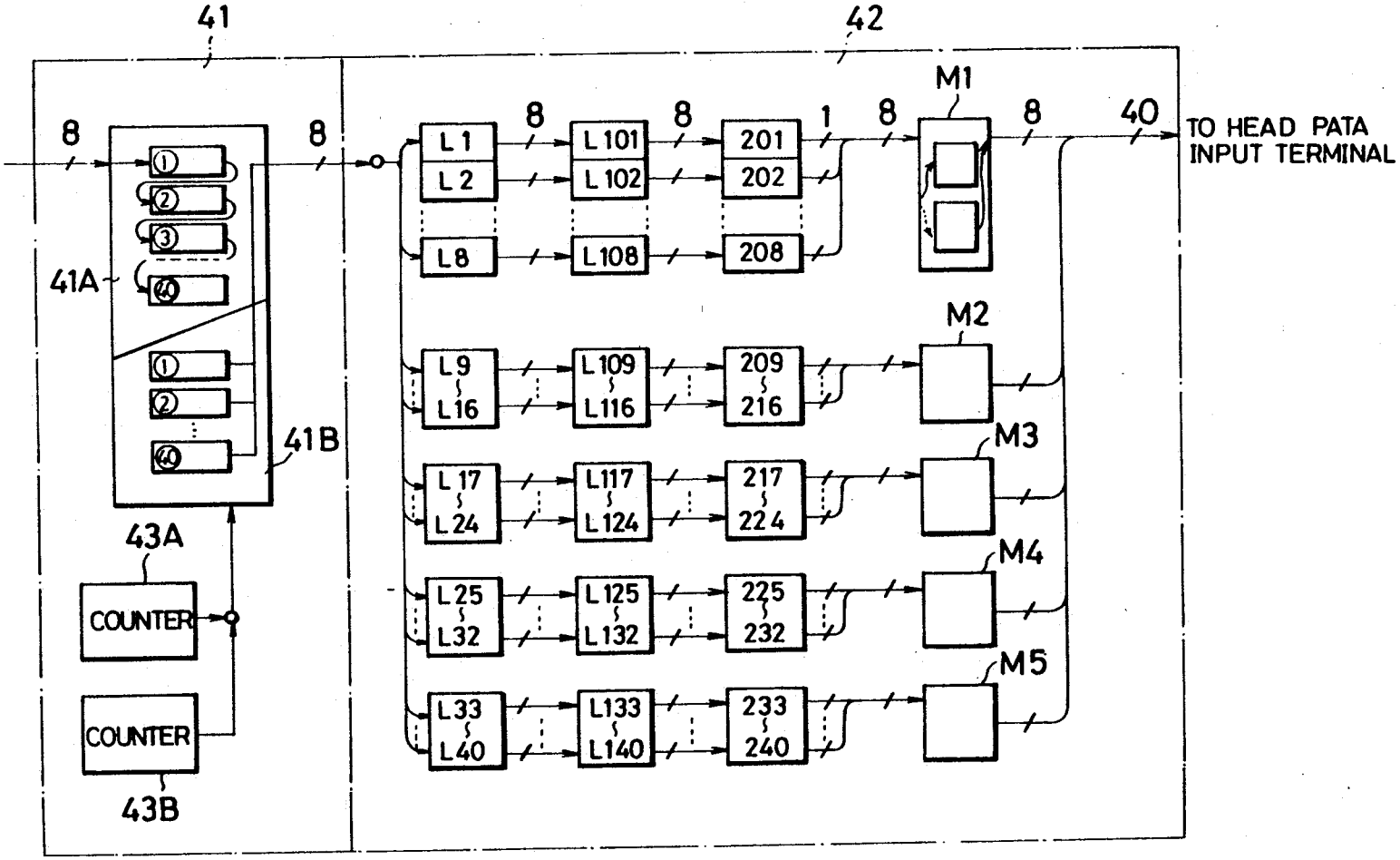
FIG. 10 is a block diagram showing a thermal head drive section in the another embodiment.
Figure 11:
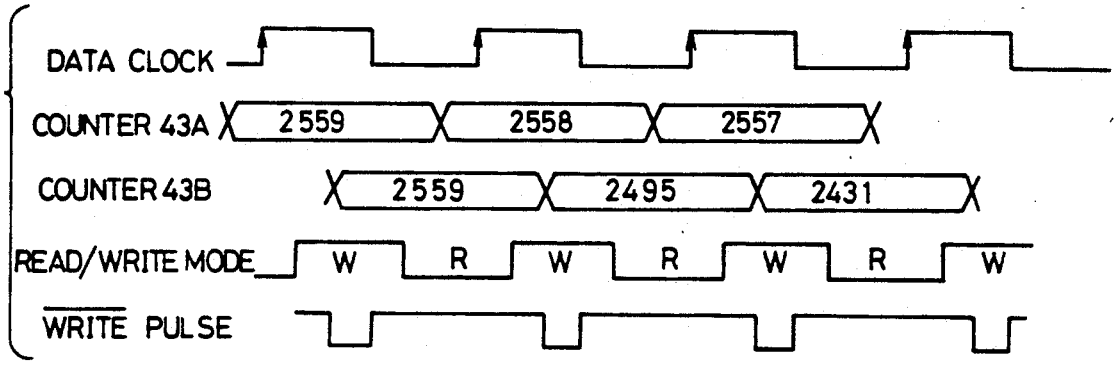
FIG. 11 is a timing chart of the above thermal head drive section.

FIG. 10 shows the thermal head drive section in this embodiment and FIG. 11 shows the timing chart thereof.

This thermal head drive section is constituted by line buffer 41 and data converting section 42. Line buffer 41 has line memories 41A and 41B each having 4K byte and alternately switched by a line synchronization signal. Counters 43A and 43B have initial value 2559 and designate addresses of line memories 41A and 41B. Counter 43A is a counter for performing the writing operation and counter 43B is a counter for performing the reading-out operation. Counters 43A and 43B count down every time when the data are written and read out, and the writing operation of the data is not performed by these counters after counting value 0. The outputs of counters 43A and 43B are switched by a read/write mode signal and therefore the output values are alternately outputted from these counters. In line memories 41A and 41B, the data from the above pulse number converting section 29 are alternately written to memory addresses at lower levels one by one such as 2559, 2558, . . . , 0. The reading-out operation of the data is performed from the memory addresses every 64 addresses such as 2559, 2495, . . . , 63, 2558, 2494, . . . , 62, . . . , 0. Such a construction is provided because each driver of the thermal head (a portion for operating the heating elements) is constructed by 64 bits.

In data converting section 43, the following nine processings are performed.

(1) The data from line memories 41A and 41B are latched to first stage latch circuits L1, . . . , L40 in a sequential order of memory addresses 2559, 2495, . . . , 63. When all the forty data have been latched to first stage latch circuits L1 to L40, the content of first stage latch circuits L1 to L40 is simultaneously latched to second stage latch circuits L101 to L140.

(2) Next, the data within second stage latch circuits L101 ot L140 are compared with number "0" by PNM (pulse number module) circuits 201 to 240 at the next stage. Namely, when these data are greater than number "0", the output is number "1", and when these data are equal to or less than number "0", the output is number "0" and these outputs are written to head memories M1 to M5 at the next stage.

(3) The data within second stage latch circuits L101 to L140 are compared with number "1" in PNM circuits 201 to 240. When these data are greater than number "1", the output is number "1", and when these data are equal to or less than numeral "1", the output is "0", and these outputs are written to head memories M1 to M5.

(4) Similarly, the data within second stage latch circuits L101 to L140 are compared with respective values from 2 to 254 PNM circuits 201 to 240 and the results are written to head memories M1 to M5.

(5) With respect to the data within head memories M1 to M40, the upper six bits show a dot number and the lower eight bits show a level number. When the data are written to head memories M1 to M5 from PNM circuits 201 to 240, the data are writen to sections indicative of dot number "0" and level numbers "0" to "255".

(6) During the above processings (2) to (5), the data from line memories 41A and 41B are latched to first stage latch circuits L1, L2, . . . , L40 in a sequential order of memory addresses 2558, 2494, . . . , 62, and are in a stand-by state.

(7) The content of first stage latch circuits L1 to L40 is latched to second stage latch circuits L101 to L140. Then, the dot number is set to number "1" in the processing (5), and the processings (2) to (5) are performed. The above processing are similarly performed until dot number "63".

(8) The data having level number "0" and dot numbers "0" to "63" are transmitted from head memories M1 to M5 to the thermal head in synchronization with a head latch signal. Next, the data having level number "1" and dot numbers "0" to "63" are transmitted from head memories M1 to M5 to the thermal head. Similarly, the data having level number ÷255" and dot mumbers "0" to "63" are transmitted from these head memories to the thermal head.

(9) Similar to line memories 41A and 41B, head memories M1 to M5 are divided into two regions having 64×256 byte and are switched every line synchronization signal.

Figure 12:
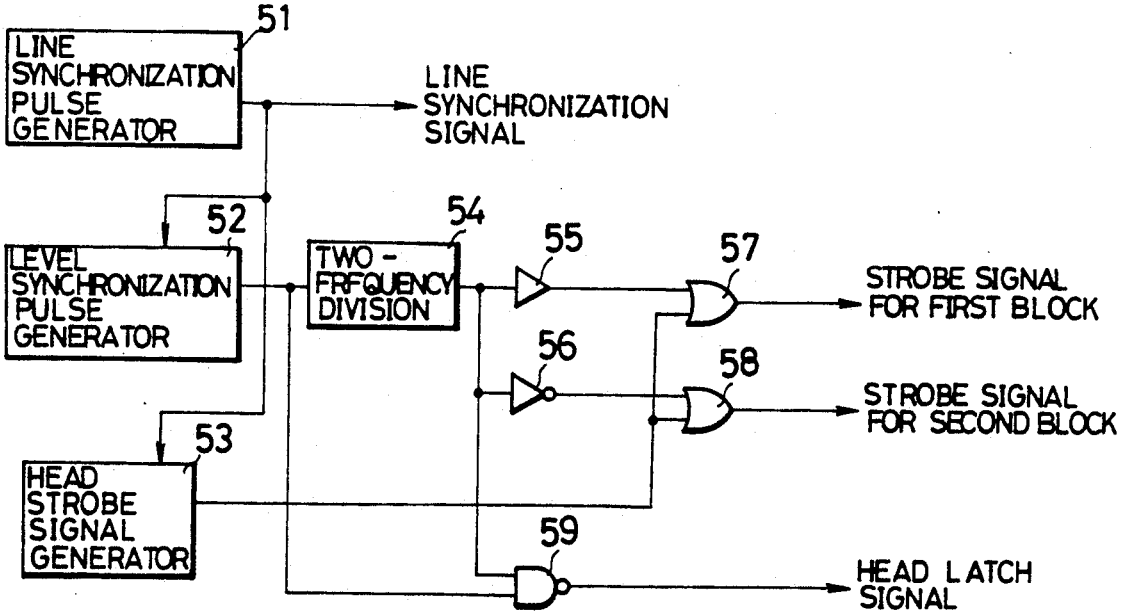
FIG. 12 is a block diagram showing the construction of a pulse width timer in the another embodiment.
Figure 13:
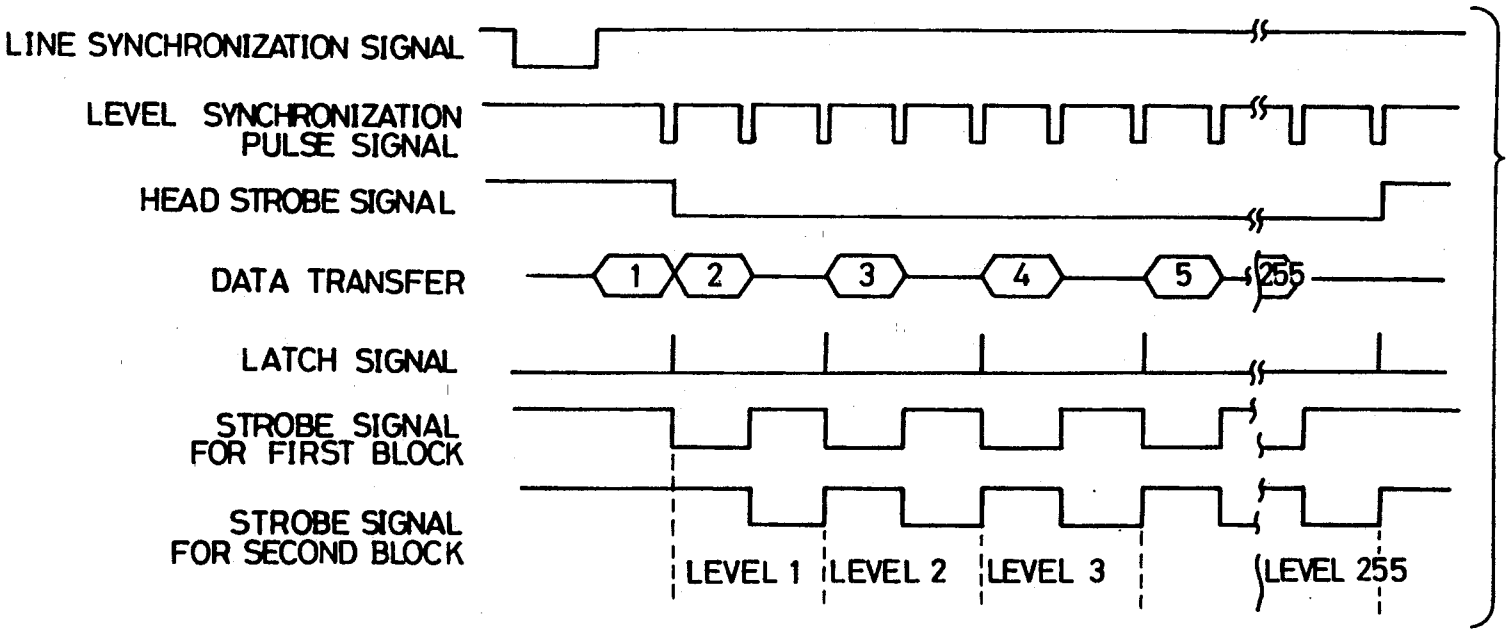
FIG. 13 is a timing chart of this pulse width timer.

FIG. 12 shows the construction of a pulse witdth timer in this embodiment and FIG. 13 shows timing chart thereof.

Line synchronization pulse generator 51 generates a line synchronization signal and transmits this signal to the thermal head, etc. Level synchronization pulse generator 52 generates a signal having as a period time t for applying energy to the heating elements of each block in the thermal head. Head strobe generator 53 generates applying enable signals at respective applying levels (respective gradation levels) 1 to 255. Level synchronization pulse generator 52 and head strobe generator 53 are respectively reset by the line synchronization signal from line synchronization pulse generator 51 and are operated from the rise of the line synchronization signal. The signal from level synchronization pulse generator 52 is divided into two signal portions by two-frequency dividing circuit 54 and is then transmitted to buffer 55 and inverter 56. An OR operation is performed by OR gates 57 and 58 with respect to the strobe signal from head strobe generator 53 and output signals of buffer 55 and inverter 56. Output signals from OR gates 57 and 58 are then transmitted to the thermal head as strobe signals for first and second blocks. Further, the output signals of two-frequency dividing circuit 54 and level synchronization pulse generator 52 are inputted to NAND circuit 59 and NAND operation is performed with respect to these input singals. The output signal of this NAND circuit 59 is transmitted to the thermal head as a latch signal. The circuit construction of the thermal head is similar to that in the above-mentioned embodiment.

In this embodiment, the level frequency with respect to the number of pulses applied to the heating elements is counted and the heating amount of the heating elements is calculated by this counted value. The number of pulses applied to the heating elements is controlled by this heating amount such that the recording density becomes constant. Accordingly, the recording density can be constantly held irrespective of the combination of the gradation data, and the construction of the apparatus is simplified.

As mentioned above, in accordance with the present invention, in the recorder for performing the recording operation at a multiple gradation by the thermal head having a plurality of heating resistors, the recording density correcting apparatus comprises a counting means for counting the level frequency with respect to the number of pulses applied to the heating resistors, a heating amount calculating means for calculating the heating amount of the heating resistors by the counted value provided by this counting means, and an applying pulse contol means for controlling the pulse width or the number of pulses applied to the heating resistors by the heating amount calculated by this heating amount calculating means such that the recording density becomes constant. Accordingly, the recording density can be constantly held irrespective of the combination of the gradation data.

Figure 14:
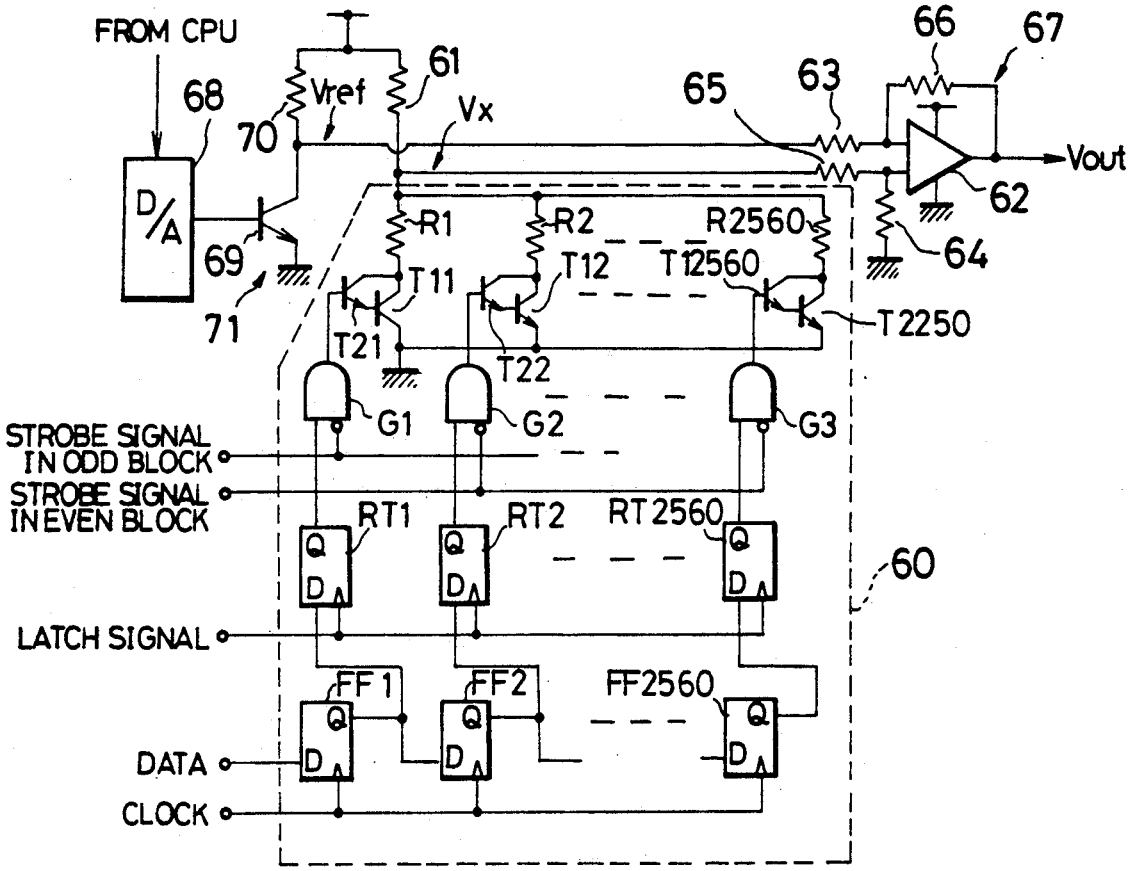
FIG. 14 is a block diagram showing a resistance value detecting section in the recording density correcting apparatus in another embodiment of the present invention.
Figure 16:
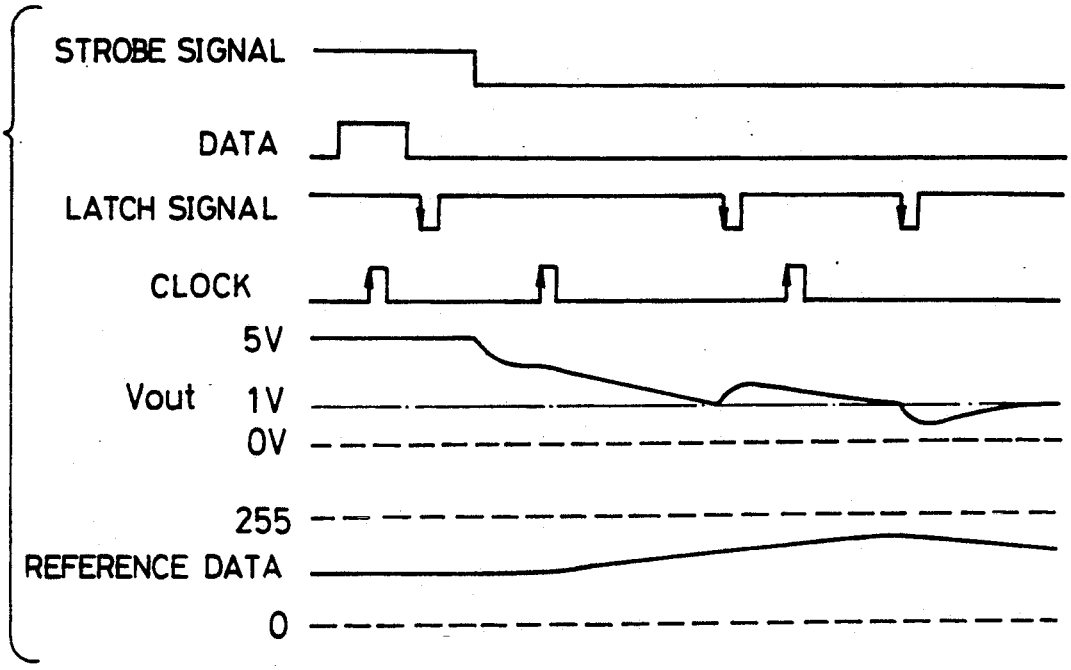
FIG. 16 is a timing chart of a mode for setting a reference voltage in the above resistance value detecting section.
Figure 17:
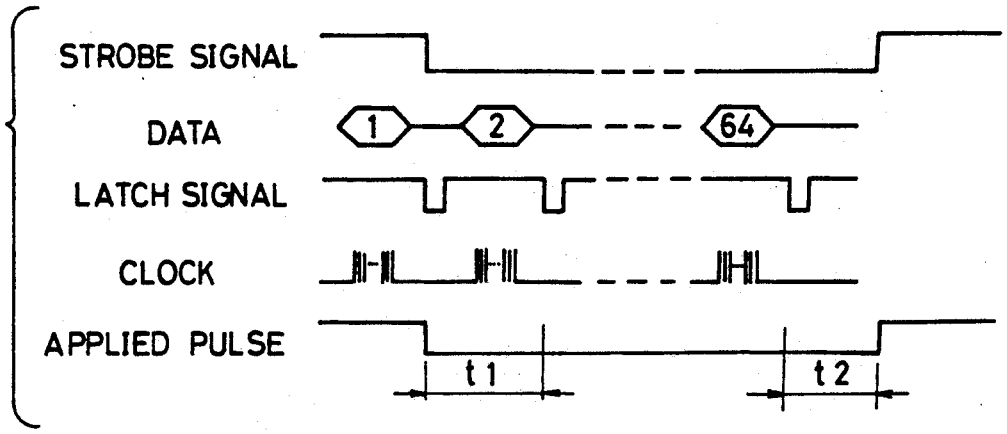
FIG. 17 is a timing chart at the normal operating time of the apparatus in the another embodiment of FIG. 14.

FIG. 14 shows a resistance value detecting section in the recording density correcting apparatus in another embodiment of the present invention. FIG. 16 shows a timing of mode for setting a reference voltage in the embodiment of FIG. 14. FIG. 17 shows a normal timing for operating the thermal head.

Figure 18:
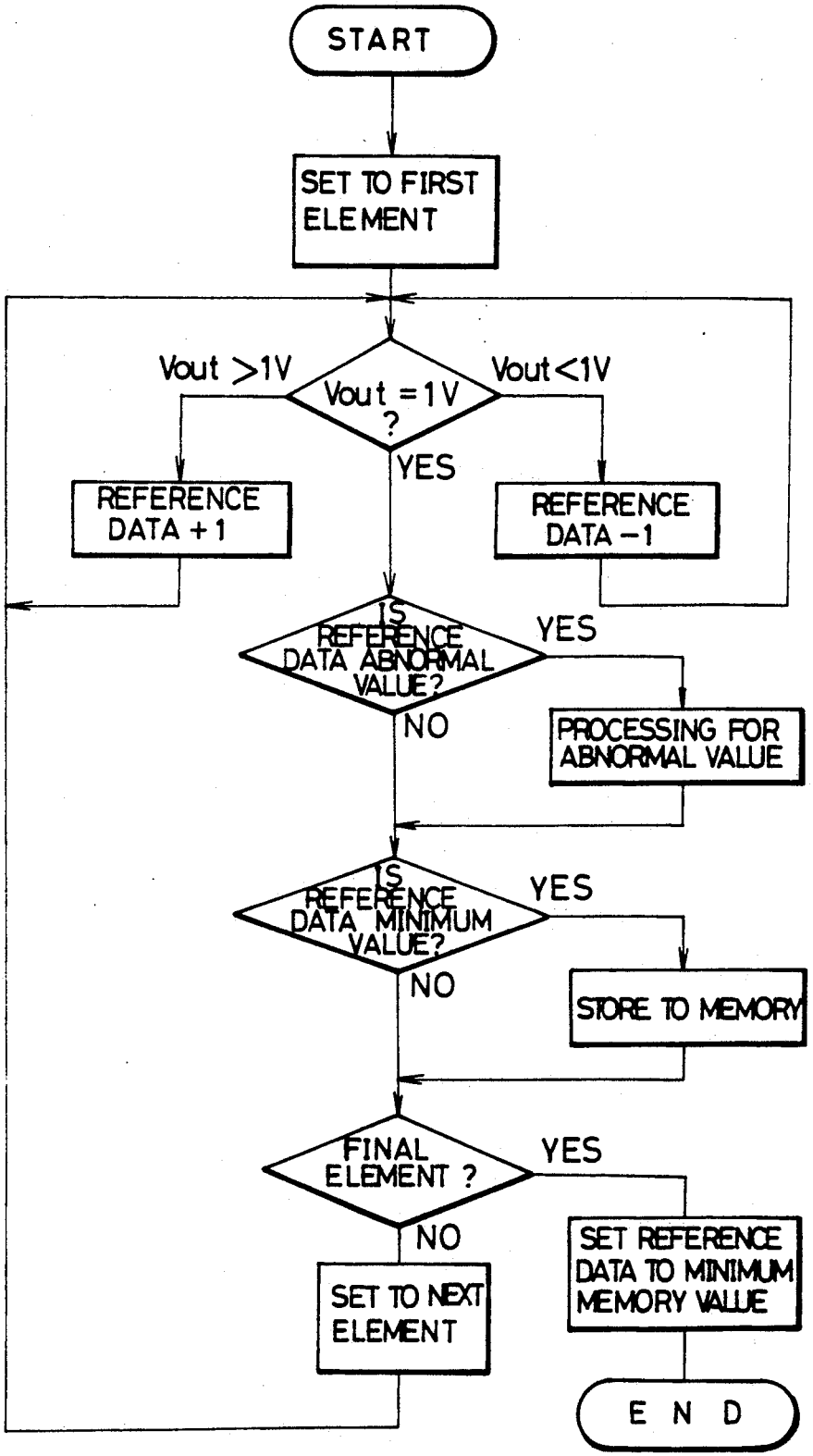
FIGS. 18 and 19 are flow charts showing processing flows of a CPU in the another embodiment of FIG. 14.

In this embodiment, the resistance value of the heating elements of the thermal head in the embodiment of FIG. 1 is detected by the resistance value detecting section and the width of pulses applied to the heating elements is corrected in accordance with this resistance value. An unillustrated microcomputer (CPU) is set by a rise of an electric power or a remeasurement switch, or inputs the image data such that a plurality of heating elements R1 to R2560 in thermal head 60 are sequentially operated one by one. Heating elements R1 to R2560 are connected to the power source through resistor 61. Only one of heating elements R1 to R2560 is operated so that its drive vlotage $V_x$ is compared with reference voltage $V_{ref}$ by differential amplifier 67 composed of operational amplifier 62 and resistors 63 to 66, and the differential voltage is then amplified. Reference voltage $V_{ref}$ is provided by converting reference data from the above CPU by digital/analog (D/A) converter 68 from a digital signal to an analog signal and amplifying the converted signal by amplifier 71 composed of transistor 69 and resistor 70. Amplification factor A of differential amplifier 67 is set such that output voltage $V_{out}$ of differential amplifier 67 does not exceed a measurable range provided by maximum and minimum values of the resistance value of heating elements R1 to R2560. output voltage $V_{out}$ of differential amplifier 67 is converted by an analog/digital converter from an analog signal to a digital signal and is inputted to the above CPU. As shown in FIG. 18, the CPU is set such that only the first heating element R1 is operated by the input of the image data. Reference voltage $V_{ref}$ is vaired by varying the above reference data such that output vlotage $V_{out}$ of differential amplifier 67 at the above setting time of the CPU is IV. When output voltage $V_{out}$ of differential amplifier 67 has become 1 V, the CPU judges whether or not heating element R1 is disconnected from the reference data at that time and the resistance value thereof is an abnormal resistance value. When heating element R1 is disconnected or its resistance value is the abnormal resistance value, a display section performs an abnormal display by the CPU. When heating element R1 is normal, the CPU judges whether the reference data are the minumum value or not, and the above-mentioned operations are sequentially performed with respect to all the heating elements R1 to R2560. When few dot portions of the thermal head at both ends thereof are constructed so as not to be operated as a print margin, the above operations are sequentially perfomed with respect to the respective heating elements in a range of the real printing opertion. As shown in FIG. 17, by the minimum value of the reference data provided by the above processing, the CPU calculates and sets time t1 from the begining end of the pulse applied to the heating elements to a time at which a color at the first level in the multiple gradation record is formed, and the change in each time until respective colors at the second level, . . . , the 64th level are formed, and the reamining time t2 by the relation provided by an experiment in advance.

Figure 15:
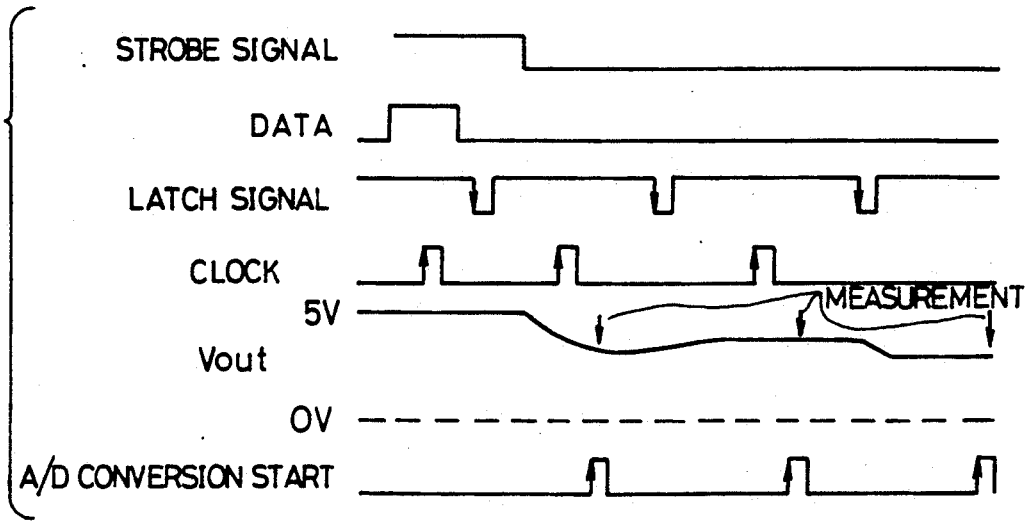
FIG. 15 is a timing chart of a resistance value measuring mode of the above resistance value detecting section.
Figure 19:
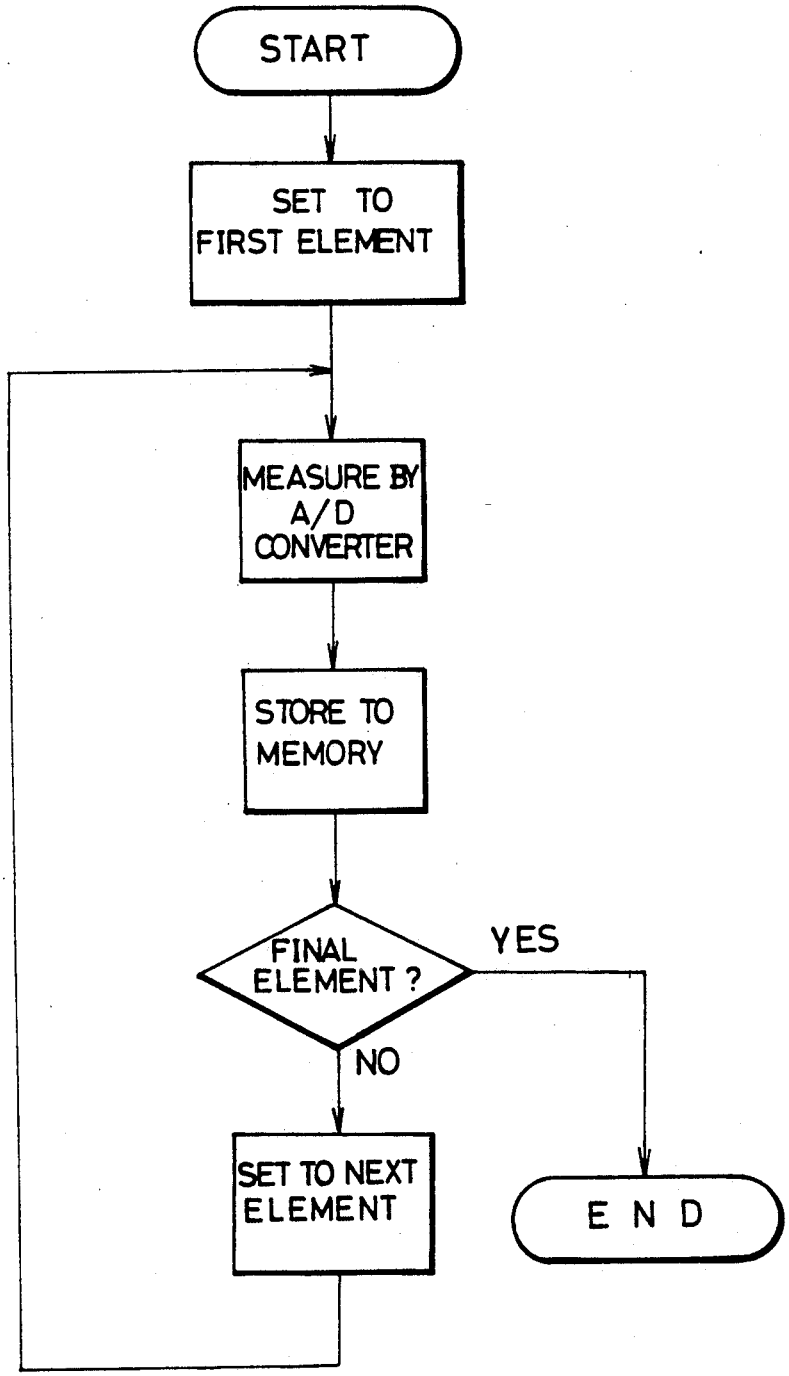

Next, as shown in FIGS. 15 and 19, the CPU sets the reference data to the minimum value provided by the above processing and operates first heating element R1. At this time, output voltage $V_{out}\{=(V_x-V_{ref})\times A\}$ of differential amplifier 67 is converted by the analog/digital converter from the analog signal to the digital signal, and this converted signal is stored by the CPU to the memory as resistance value data of heating element R1. The CPU sequentially performs such operations with respect to all the heating elements and calculates average resistance value $\overline{R}$ of all the heating elements from the obtained resistance value data of the respective heating elements.

Figure 20:
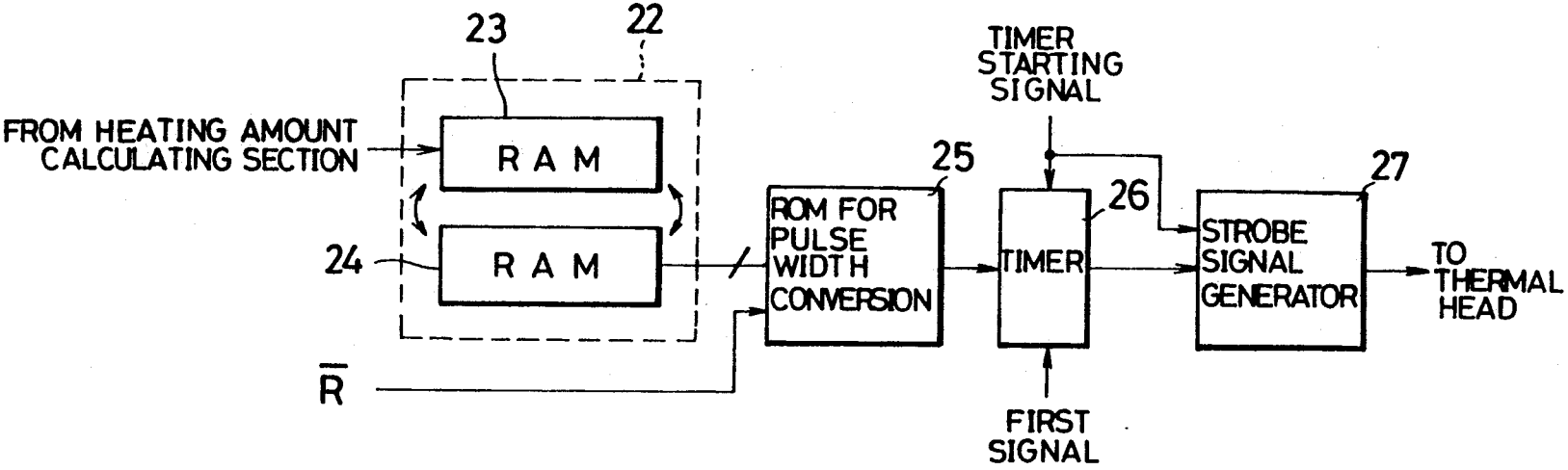
FIG. 20 is a block diagram showing the pulse width converting section in the another embodiment of FIG. 14.

FIG. 20 shows a section for converting the pulse width in this embodiment.

Figure 21:
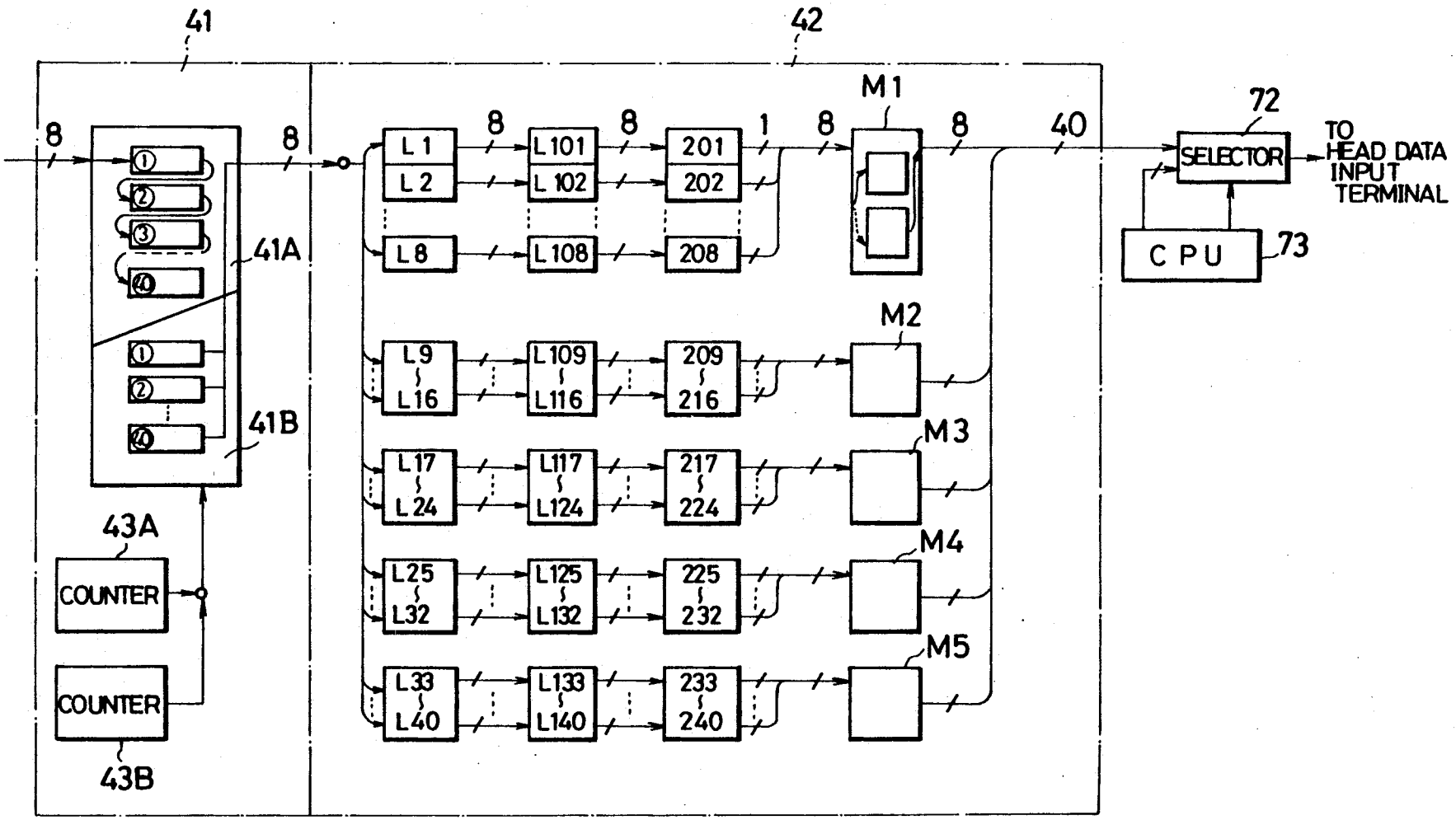
FIG. 21 is a block diagram showing the thermal head drive section in the another embodiment of FIG.

In this pulse width converting section, average resistance value $\overline{R}$ of all the heating elements calculated by the above CPU in the embodiment of FIG. 1 is inputted to the ROM for pulse width conversion. The addresses of the ROM for pulse width conversion are designated by the output of RAM 22 for pulse width and average resistance value $\overline{R}$ of all the heating elements. By reading data out of the ROM for pulse width conversion, the output of RAM 22 for pulse width and average resistance value $\overline{R}$ of all the heating elements are converted to a timer value for canceling the change in recording density by the number of heating elements sumulataneously operated and the change in recording density by the dispersion in average resistance value $\overline{R}$ of all the heating elements. Accordingly, even when the thermal heads are exchanged and the resistance value of the heating elements is changed, the width of the pulse applied to the heating elements is correspondingly corrected so that the change in recording density is corrected. In this case, the ROM for pulse width conversion inputs thereto a first signal indicative of a first data transfer and the first signal attains a high voltage level at only the time of the first data transfer. The ROM for pulse width conversion outputs the above-mentioned signal indicative of time t1 at the high voltage level of the first signal, and outputs the above signal indicative of time t2 in the second data transfer or later when the first signal attains a low voltage level. In this embodiment, as shown in FIG. 21, selector 72 is controlled by a select signal from CPU 73 and the data from head memories M1 to M5, etc., the strobe pulse, the latch signal and the clock signal are normally transferred to thermal head 60 through selector 72. At the measuring time of the above resistance value, the data from CPU 73, the strobe pulse, the latch signal and the clock signal are transferred to thermal head 60 through selector 72.

In accordance with the another embodiment of the present invention mentioned above, the construction of the apparatus is simplified and the recording density can be constantly held in the recorder for recording an image at a multiple gradation.

Further, the recording density correcting apparatus is provided with a correcting means for correcting the pulse width or the number of pulses applied to the heating elements by detecting the respective resistance values of the plurality of heating elements such that the recording density becomes constant. Accordingly, it is not necessary to make correction data every time when the thermal heads are exchanged.

Many widely different embodiments of the present invention may be constructed without departing from the spirit and scope of the present invention. It should be understood that the present invention is not limited to the specific embodiments described in the specification, except as defined in the appended claims.

What is claimed is:

1. A recording density correcting apparatus in a recorder for performing a recording operation at a multiple gradation by a thermal head having a plurality of heating resistors, said apparatus comprising:

counting means for counting a level frequency with respect to a number of pulses applied to each of the heating resistors;

calculating means for calculating a number of simultaneously operated heating resistors at each gradation level by the counted value provided by said counting means; and pulse control means coupled with said calculating means for controlling the pulse width or the number of pulses to be applied to the heating resisitors by the number of simultaneously operated heating resistors calculated by said calculating means such that the recording density becomes constant.

2. An apparatus according to claim 1, wherein said counting means is adapted to count a level frequency on one line by counting the level frequency of a pulse number signal indicative of a number of applied pulses of each of the heating resisitors.

3. An apparatus according to claim 1, wherein said calculating means is adapted to calculate the number of simultaneously operated heating resisitors at each gradation level by subtracting the level frequency from a predetermined value at each gradation level.

4. An apparatus according to claim 1, wherein said apparatus further comprises one line buffer for accumulating a pulse number signal indicative of a number of applied pulses of each of the heating resistor.

5. An apparatus according to claim 4, wherein the pulse number signal accumulated in the one line buffer is converted based on the calculated number of simultaneously operated heating resistors at each gradation level to data for canceling a change in recording density by the number of said simultaneously operated heating resistors at each gradation level.

6. An apparatus according to claim 1, wherein said pulse control means is adapted to accumulate the number of simultaneously operated heating resistors at each gradation level calculated by the calculating means.

7. An apparatus according to claim 1, wherein the recording density is constantly controlled by changing time for applying energy to the thermal head based on the number of operated heating resistors at each gradation level.

8. An apparatus according to claim 1, wherein said apparatus further comprises correcting means for correcting the pulse width or the number of pulses applied to the heating resistors by detecting respective resistance values of the plurality of heating resistors such that the recording density becomes constant.

9. An apparatus according to claim 8, wherein said correcting means comprises a differential amplifier for comparing a voltage for operating only one heating resistor with a reference voltage.

10. An apparatus according to claim 9, wherein the differential voltage from the differential amplifier is amplified.

11. An apparatus according to claim 8, wherein the width of pulses applied to the heating resistors is correspondingly corrected so that the change in recording density is corrected when the thermal heads are exchanged and the resistance values of the heating resistors are changed.

12. A thermal printer comprising:

a thermal head having a number of heating resistors for printing dots having multiple gradation levels at a printing line;

a source of pulse number signals for operating respective heating resistors to print a current line of dots; and a recording density correcting circuit apparatus which comprises:

a counting circuit coupled with said source to receive the pulse number signals for counting a level frequency representative of the number of pulses designated by the pulse number signals for the respective heating resistors to be operated for printing the current line;

a calculating circuit coupled to the counting circuit to receive the level frequency therefrom and in response to calculate and to output a calculated signal representative of a number of simultaneously operated heating resistors at each gradation level for the current line of dots; and a pulse control circuit coupled with said calculating circuit and responsive to said calculated signal to control the pulse width or the number of pulses to be applied to the heating resistors of the thermal head for the current line of dots in order to reduce variations in recording density in the current line of dots due to variations in the number of heating resistors operating to print the current line of dots.

13. A thermal printer according to claim 12 including a correcting circuit coupled with the heating resistors for calculating a correction signal related to differences in the resistance values of the heating resistors and for using the correction signal to reduce variations in the density of the dots in the current line due to differences in the resistance values of the heating resistors.

* * * * *